United States Patent [19]

Fallen

[11] 4,386,442

[45] Jun. 7, 1983

[54] SPEED FLOOR BUFFER BEARING CONSTRUCTION

[76] Inventor: Burke Fallen, 1030 Rockridge Ct., Pittsburg, Calif. 94565

[21] Appl. No.: 342,843

[22] Filed: Jan. 26, 1982

[51] Int. Cl.[3] ..... A47L 11/14

[52] U.S. Cl. ..... 15/98; 51/177

[58] Field of Search ..... 15/49 R, 50 R, 98, 385; 51/177

[56] References Cited

U.S. PATENT DOCUMENTS 3,098,329 7/1963 Doran ..... 51/177

4,155,138 5/1979 Fallen ..... 15/98

*Primary Examiner*—Edward L. Roberts

*Attorney, Agent, or Firm*—Manfred M. Warren; Robert B. Chickering; Glen R. Grunewald

[57] ABSTRACT

A floor buffing machine having a pivoted buffer plate holding means to keep the buffer flat on the floor as the buffing pad wears is improved by a drive which includes a pulley on a shaft journaled above and below a yoke to provide a pulley that is above both bearings and is therefore free to have a drive belt installed or removed without disassembling the buffer plate holding means.

1 Claim, 2 Drawing Figures

SPEED FLOOR BUFFER BEARING CONSTRUCTION

BACKGROUND OF THE INVENTION

This invention relates to power-driven floor buffing machines of the type shown in my U.S. Pat. Nos. 3,977,421, 4,069,538, and 4,155,138.

Professional floor buffing machines are normally supported on a pair of wheels and the buffing pad extends in front of the wheels while an operating handle extends from behind them. During buffing three parts of the buffer are in contact with the floor, namely, each of the wheels and the buffing pad. The buffing pad is driven by a motor and it is mounted on a vertical shaft that is coupled either directly to the motor or to a pulley that is driven by the motor.

In the past, as buffing pads wore the chassis on which the wheels and the buffing pad support are mounted would not be horizontal and only an edge of the buffing pad would contact the floor instead of the full face of the buffing pad. Devices that are the subject of my above-noted prior patents overcame that difficulty by mounting the buffing pad on a yolk-like element that was pivoted on an axis that was parallel to the axis on which the wheels rotated whereby, as the buffing pad wore down and the front of the device tipped toward the floor, the buffing pad could pivot on that axis and still provide a full-face engagement with the floor being buffed.

With the arrangement described above, as the buffing pad wore out the pulley driving the buffing pad and the pulley acting as a power take off from the motor became out of alignment, specifically, they were no longer in the same plane. As a result belt wear increased and it became necessary to change the belt between the power take off from the motor and the buffing pad drive system more frequently. Changing a belt requires removing the pad support member from the chassis, changing the belt, and then fixing the pad support member back on the chassis. Although not a difficult job, it does require down time and aligning cumbersome parts, such as the chassis and the pad support member to reassemble them.

SUMMARY OF THE INVENTION

This invention is a power driven floor buffer made in accordance with the prior art but improved in the respect that it is constructed to provide rapid and convenient changing of drive belts without the need for disassembling any portion of the buffer.

The device of this invention is a floor buffing machine which includes a chassis mounted on a pair of wheels that rotate on a common axis. The chassis carries a drive motor and it is adapted to receive a support member for a buffing pad. The support member for the buffing pad includes a means for attaching the support member to the chassis and a pair of shafts journaled along a common axis that is parallel with the axis of the wheels mounted on the chassis. All of the foregoing is in accordance with the prior art.

In the present invention however, the buffing pad support member includes a lower yoke element having a substantial thickness and having a bearing attached to the yoke on its upper surface and a second bearing attached to the yoke on its lower surface so that the two bearings are coaxial. In the device of the present invention a shaft passes through the two bearings on the yoke. The upper portion of the shaft is connected to a pulley to drive the buffing pad, and a drive plate adpated to connect to a buffing pad is connected to the lower portion of that shaft. The pulley at the upper portion of the shaft and the yoke are dimensioned so that the pulley connected to the top of the drive shaft is spaced a great enough distance horizontally from the yoke and a great enough distance vertically from the chassis to permit a drive belt to be inserted over the pulley while the pulley is in place on the yoke. Specifically, the horizontal distance between the pulley and the yoke is at least the thickness of the drive belt and the vertical distance between the pulley assembly and the chassis is at least the thickness of the drive belt.

The device made in accordance with this invention, particularly if the motor mounted on the chassis is moveably mounted, for example with bolts set in slots, can have its drive belt changed without disassembling the device.

DETAILED DESCRIPTION OF THE INVENTION

Figure 1:
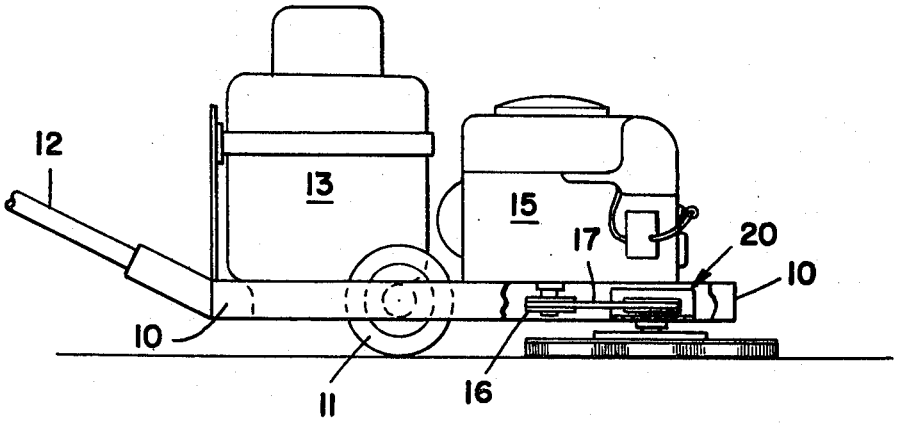
FIG. 1 is a partial elevation view of a floor buffer including a means for mounting the buffing pad made in accordance with this invention, partially in section as taken along the line 1—1 of FIG. 2.

The device of this invention is employed in a floor buffing machine such as illustrated in FIG. 1. The floor buffing machine has a chassis 10 on which the other elements are supported. A pair of wheels 11 are mounted on the chassis on either end of the axel and an operating handle 12 is connected to the chassis. The wheels 11 are positioned on the chassis so that the various elements of the device create a center of gravity forward of the wheels to produce a downward force on the buffing pad. The chassis also supports a vessel 13 that holds material useful for buffing floors such as wax or cleaner and a motor 15 that provides the power to drive the buffing wheel. The motor 15 may be electrically operated or a gasoline engine depending on where the device is to be used.

Figure 2:
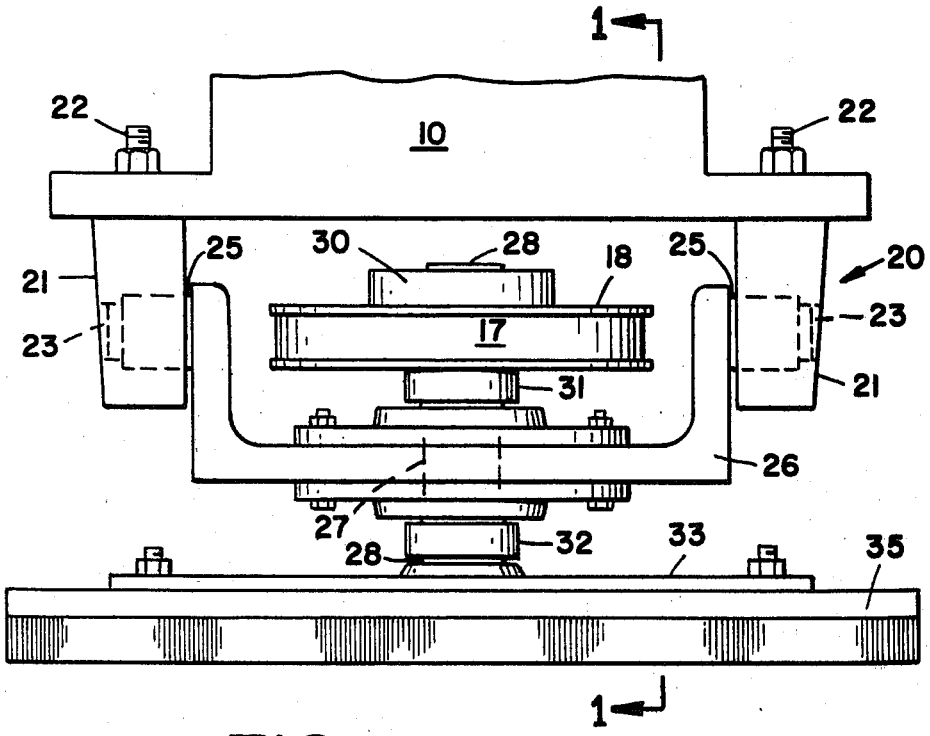
FIG. 2 is a right-side view of the device of FIG. 1 showing the buffing pad support member embodying this invention in an enlarged view.

Motor 15 is provided with a power take off in the form of pulley 16 which drives a belt 17. The belt 17 connects with a pulley 18 that is part of the buffing pad support member that is generally designated 20 and shown in greater detail in FIG. 2.

The buffing pad support member 20 includes a pivotal connection on an axis parallel to the axle of the wheels 11. In the embodiment illustrated the support member 20 is connected to the chassis 10 through connection elements 21 each of which is provided with a means, such as a threaded fastner 22 to connect it to the chassis 10. Each of the connection elements 21 also is provided with a hole 23 into which a short axle 25 may be placed. The short axle 25 holds a yoke 26 so that it may rotate around the common axis of axles 25. It is contemplated, in use, that there will be very little relative rotational movement between axles 25 and holes 23 so a special bearing material normally is not necessary. The rotation of axles 25 merely permits the buffing pad to lie flat against the floor even when the chassis 10 is not parallel to the floor.

Yoke 26 is provided with a central opening 27 through which a shaft or axle 28 may pass. Shaft 28 is fixed with a collar or other means 30 to hold it in position. A set screw or a key may be employed to hold the shaft 28 and collar 30 together.

A first bearing 31 is connected the upper surface of yoke 26 and a second bearing 32 is fixed to the lower surface of yoke 26 with suitable means such as bolts, as shown. The shaft 28 extends through both of bearings 31 and 32 and is fixed firmly to a buffing pad support plate 33. A buffing pad 35 is connected to the plate 33 by known means such as the bolts illustrated.

In use with a new buffing pad 35, the device will function as illustrated in FIG. 1. The fresh pad will be thick enough so that chassis 10 will be substantially parallel with the plane of the floor. As buffing progresses pad 35 will wear down, the front of the device illustrated in FIG. 1 will tip toward the floor so that the plane in which chassis 10 lies converges with the plane of the floor, yoke 26 will pivot around hole 23 so that the buffing pad 35 will remain flat against the floor being buffed and buffing will be accomplished efficiently.

However, as yoke 26 pivots around axels 25 the plane in which pulley 18 rotates becomes slightly different from the plane in which pulley 16 rotates. As a result, the wear on belt 17 increases so that its useful life is diminished. In accordance with this invention, belt 17 can be easily changed without disassembling the buffer with which it is used. Belt 17 can be removed and a new belt replaced by working the belt off of either pulley 16 or 18, sliding it over the top of pulley 18 and beneath pulley 16 and simply removing it from the device. A new belt can be installed by the reverse procedure. In order to change the belt easily it is required first that both bearings 31 and 32 are beneath pulley 18, second that the clearance between pulley 18 and yoke 26 be at least a belt width, and that the clearance between the top of shaft 28 and chassis 10 be at least a belt width.

Depending on the tightness of belt 17, it may be possible to simply work belt 17 off of the pulleys and replace it by working a new belt on the pulleys. It may be desirable to loosen motor 15 so that pulleys 16 and 18 may be moved closer together during the belt changing operation. However, loosening a nut and sliding two elements toward one another to remove a belt and away from one another to tighten a belt is a substantially easier and less time consuming operation than dismantling the yoke structure 26 completely in order to remove a belt, as is the situation when the shaft 28 is journaled on opposite sides of pulley 18 as in accordance with the prior art.

What is claimed is:

1. A floor buffing machine comprising a chassis; a pair of floor-engaging wheels mounted on the chassis on a common axis of rotation for movement over the floor to be buffed; a motor drive carried by said chassis; a buffing pad support member having a pair of spaced apart, oppositely extending first shafts journaled on said chassis along a common, normally substantially horizontal axis parallel to said wheel axis and offset therefrom for movement toward and away from the floor upon pivoting said chassis around said wheel axis; a drive plate having a normal horizontal planar position in use and adapted for support of a disc-shaped buffing pad at the underside thereof; a third shaft secured centrally to said plate and extending substantially perpendicular thereto from the upper side therof, said third shaft being journaled by a first bearing above said member and a second bearing beneath said member along an axis extending between said first shafts and intersecting and perpendicular to said common axis thereof; a belt sheave mounted on said third shaft above said first bearing in the plane of said common axis and adapted for belt drive connection to said motor drive, said belt sheave being spaced horizontally at least the thickness of a belt from said member and vertically at least the thickness of a belt from said chassis.

* * * * *